US006953419B2

(12) United States Patent
Wang et al.

(10) Patent No.: US 6,953,419 B2
(45) Date of Patent: Oct. 11, 2005

(54) DISPLACEMENT DETECTOR OF A PLATFORM FOR AN EXERCISE APPARATUS

(76) Inventors: Leao Wang, No. 1, Lane 233, Sec.2, Charng Long Rd., Taiping (TW), 411; Peter Wu, No. 1, Lane 233, Sec.2, Charng Long Rd., Taiping (TW), 411

( * ) Notice: Subject to any disclaimer, the term of this patent is extended or adjusted under 35 U.S.C. 154(b) by 0 days.

(21) Appl. No.: 10/647,577

(22) Filed: Aug. 26, 2003

(65) Prior Publication Data

US 2004/0204295 A1 Oct. 14, 2004

Related U.S. Application Data

(63) Continuation-in-part of application No. 10/410,815, filed on Apr. 11, 2003, now Pat. No. 6,719,669.

(51) Int. Cl.[7] ..... A63B 22/02
(52) U.S. Cl. ..... 482/54
(58) Field of Search ..... 482/51, 54; 73/379.01

(56) References Cited

U.S. PATENT DOCUMENTS 2,017,128 A * 10/1935 O'Neill, Jr. ..... 482/54
5,993,358 A * 11/1999 Gureghian et al. ..... 482/54
6,193,634 B1 * 2/2001 Hurt ..... 482/54
6,254,515 B1 * 7/2001 Carman et al. ..... 482/54
6,494,814 B1 * 12/2002 Wang et al. ..... 482/54
6,719,669 B1 * 4/2004 Wang et al. ..... 482/54
6,723,028 B1 * 4/2004 Wang et al. ..... 482/54

* cited by examiner

*Primary Examiner*—Stephen R. Crow
(74) *Attorney, Agent, or Firm*—Troxell Law Office PLLC

(57) ABSTRACT

A displacement detector of a platform for an exercise apparatus includes a rope movably tensioned by a rotating element between fixed points on the base and the upright support, respectively. When the platform is forced to move upwardly and downwardly, the rotating element undergoes an in-place rotation by the pulling force of the rope. Thereafter, a means for detecting the rotational displacement of the rotating element, which corresponds to the supporting force of the cushioning elements, is positioned beside the rotating element on the platform. Then, the detected value is transmitted to a microprocessor in the control console.

2 Claims, 4 Drawing Sheets

DISPLACEMENT DETECTOR OF A PLATFORM FOR AN EXERCISE APPARATUS

This invention is a continuation-in-part of U.S. patent application Ser. No. 10/410,815 filed Apr. 11, 2003, now U.S. Pat. No. 6,719,669.

BACKGROUND OF THE INVENTION

1. Field of the Invention

The invention relates to a displacement detector of a platform for an exercise apparatus, and more particularly, to a device utilizing a rope, a rotating element and a detecting means mounted either on one side of the platform or on a connection piece for exactly controlling the loading displacement of the platform. Therefore, the detected value serves as reliable reference in measuring and adjusting the supporting force of the cushioning unit.

2. Description of the Related Art

To take a treadmill as example for the above-mentioned exercise apparatus. In general, the treadmill is provided with cushioning units at suitable places for achieving a proper cushioning effect. Meanwhile, the supporting force of the cushioning unit plays an important part in enhancing the comfort of the operator during a workout session. Moreover, a complete and direct protection from injuries of both feet of an operator is dependent upon the functioning of the cushioning unit. At present, hydraulic or pneumatic cylinders are often used to provide a more excellent cushioning effect. A few prior arts such as U.S. Pat. No. 4,591,147, U.S. Pat. No. 5,184,988, U.S. Pat. No. 4,974,831, U.S. Pat. No. 4,984,810, U.S. Pat. No. 5,072,928, U.S. Pat. No. 5,372,559, etc. have disclosed hydraulic or pneumatic cylinders applied to the treadmill for meeting different using needs.

As everyone knows, the exercise on the treadmill can be classified into warm-up walking, jogging with constant speed, speed-up jogging and slow-down walking to restore the heart beat to an optimal state. Therefore, the force acting on the treadmill's platform is not a constant value; for example, the walking and jogging exercises make much difference in the applied force. Accordingly, the optimal cushioning force can't be reached in certain stages during the whole workout session if the cushioning force is set at a predetermined value. For example, the operator feels comfortable under the influence of the cushioning unit set at a predetermined value during a slow walking session. However, he will feel during a jogging session that the supporting force under same influence of the cushioning unit is insufficient and his feet sink too much. This is an important factor that causes exercise injuries. Of course, the operator can adjust the cushioning unit to raise cushioning force immediately when he feels that it's too little. However, the operator has to interrupt his workout session. Moreover, he will still be unsatisfied with cushioning force when he changes the speed-up jogging session to the slow-down walking session again. Thus, this brings him much trouble and disappointment about the treadmill.

In addition, an operator with heavier weight would feel that the cushioning force is too slight while an operator with lighter weight could feel that it is too strong if the cushioning force is fixed at a certain value. Besides, different operators have their own subjective feeling about the cushioning strength no matter how large or slight the cushioning force is. In addition, some operators have special rehabilitation requirements thereto. Accordingly, the prior arts are required for improvement.

SUMMARY OF THE INVENTION

It is a primary object of the present invention to remove the above-mentioned drawbacks and to provide a displacement detector that is disposed at a suitable place of an exercise apparatus with loaded platform and constantly creates detection values to transmit to the control console on the exercise apparatus. The detection value is evaluated by a built-in microprocessor to proceed with automatic adjustments. Alternatively, the detection value can be directly displayed on the panel of the control console. Therefore, the operator can realize the real-time supporting force of the cushioning unit during the workout session and make a note of his personally most suitable value of the supporting force of the cushioning unit. This can be a reference value serving as the preset value for the cushioning unit of exercise apparatus. Besides, the control console may automatically undergo adjustment according to the detection value by use of a built-in program. Accordingly, a desired cushioning effect can be achieved during the whole workout session.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
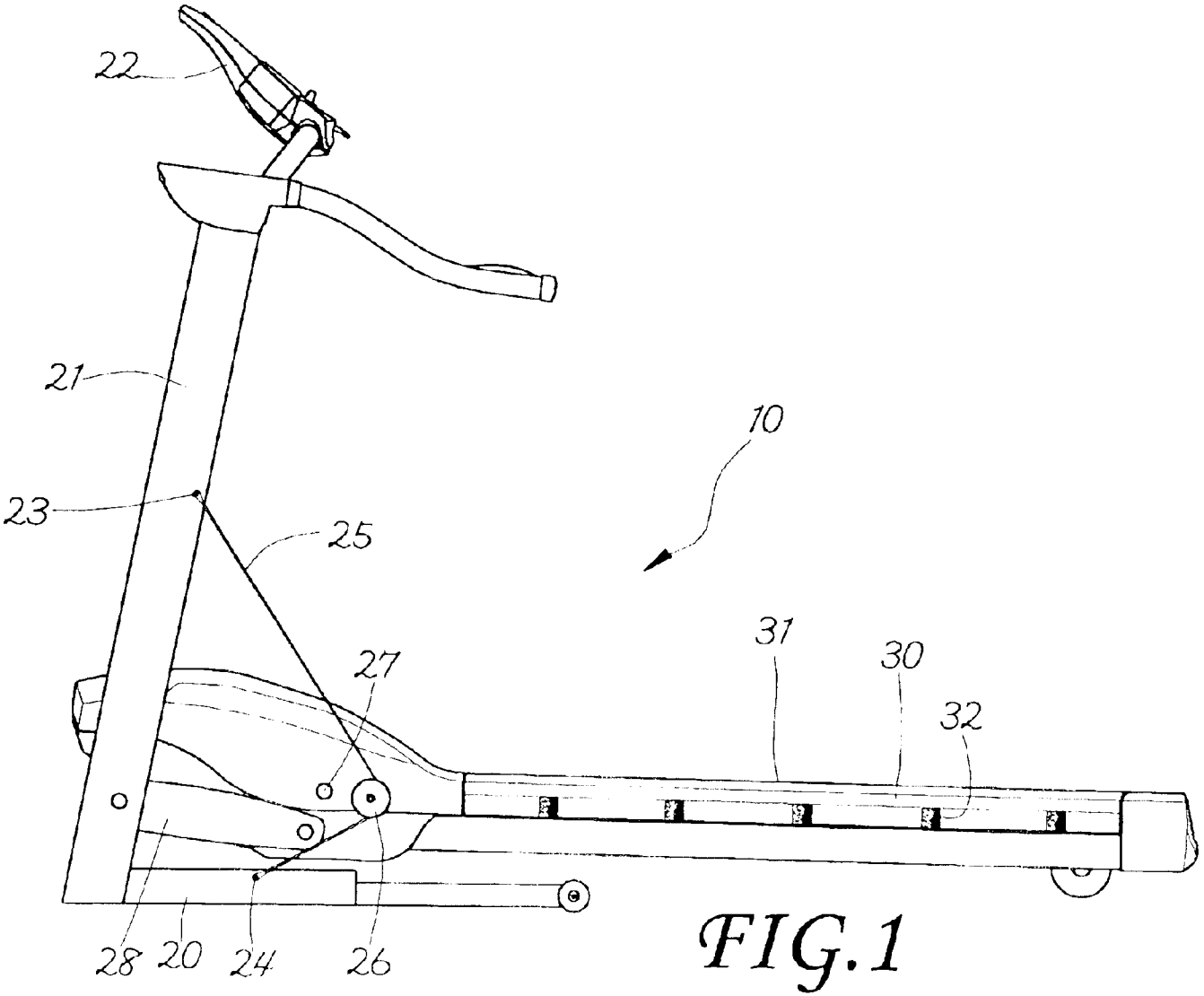
FIG. 1 is a schematic drawing of an embodiment of the invention.
Figure 2:
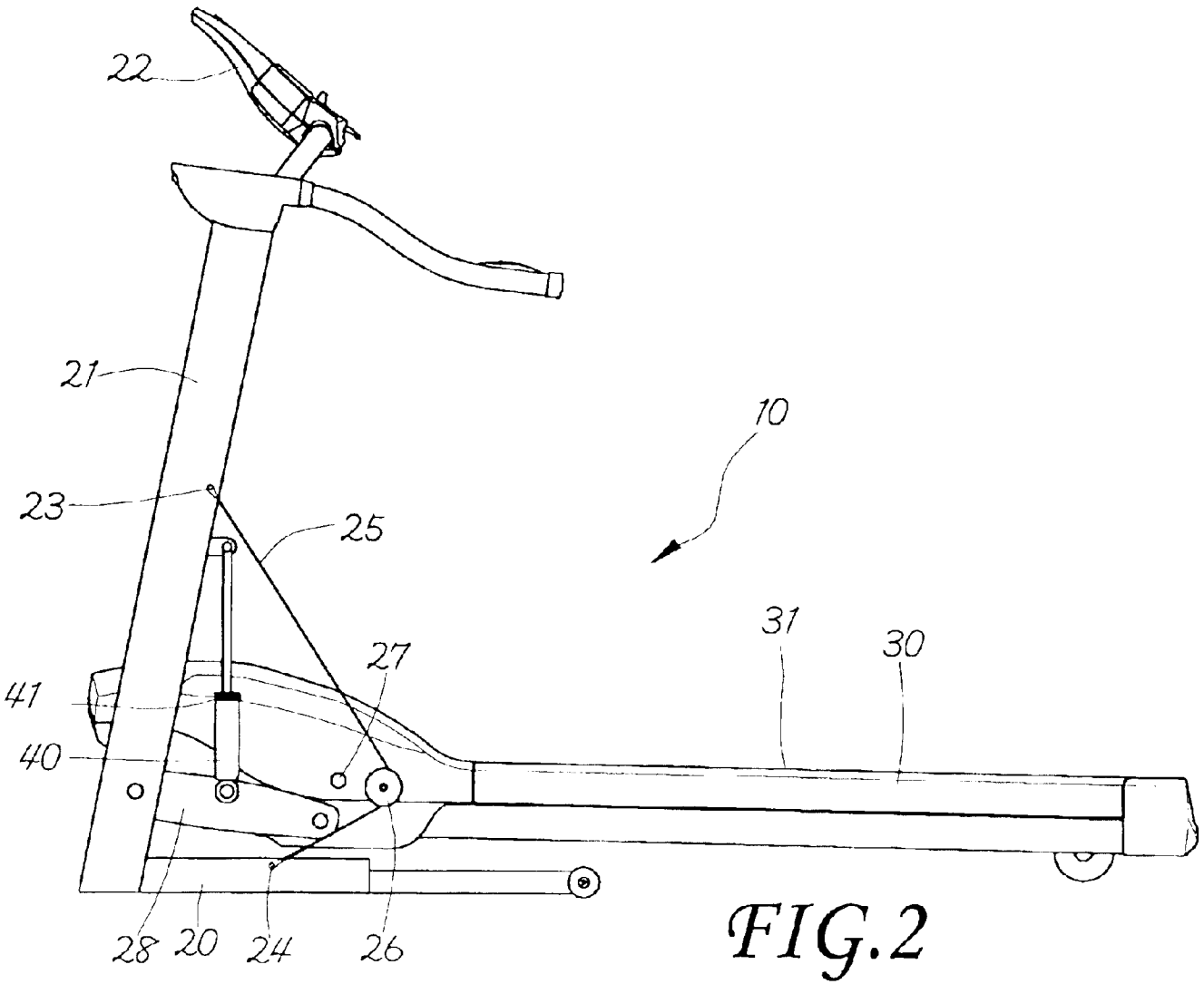
FIG. 2 is a schematic drawing of another embodiment of the invention.

As shown in FIGS. 1 and 2, the treadmill 10 includes a base 20 and a platform 30. Both sides of the base 20 extend upwardly to form two opposing upright supports 21. A control console 22 is disposed above the upright support 21. Moreover, a continuous belt 31 is mounted around the platform 30 for undergoing an in-place rotation. Therefore, the operator can stand on the continuous belt 31 for taking walking, jogging or running exercise. Moreover, the bottom of the platform 30 is provided with a plurality of regularly spaced cushioning elements 32 (rubber pads as shown in FIG. 1) for acting supporting (or cushioning) force against the load from the platform 30.

The displacement detector of the invention includes a rope 25 movably tensioned by a rotating element 26 between two fixed points 23, 24 on the base 20 and the upright support 21, respectively. When the platform 30 is forced to move upwardly and downwardly, the rotating element 26 undergoes an in-place rotation by the pulling force of the rope 25. Thereafter, a means 27 for detecting the rotational displacement of the rotating element 26, which corresponds to the supporting force of the cushioning elements 32, is positioned beside the rotating element 26 on the platform 30. Then, the detected value is transmitted to a microprocessor (not shown) in the control console 22.

Based upon the above-mentioned configuration of the invention, the value of the supporting force detected by the detecting element 27 can be transmitted to the microprocessor of the control console 22 and shown on a display panel (not illustrated in figures). Accordingly, the manufacturers may utilize this apparatus to set different reference values before delivery of products by use of cushioning elements 32 of different amount and materials, thereby producing treadmills 10 with different cushioning effect for meeting various personal requirements of consumers. When the detection value of the cushioning force is abnormally too high or too low, or when the operator wants to adjust its value, he may ask the manufacturer for an optimal adjustment or for a replacement of the cushioning elements 32 according to the detection value. Thus, the operating comfort may always remain in a perfect state.

In other words, the manufacturers can develop a more personalized product by adding the invention to different exercise apparatuses. Meanwhile, the resisting force of the cushioning elements 32 may be followed up by the detection value for ensuring the product quality. Moreover, the detection value is also applicable in manufacturing and servicing the products. Therefore, the consumer can obtain a long-term excellent operating comfort and a better after-sale service.

Furthermore, referring to FIG. 2, the invention is applied to a more modern treadmill having instead of the cushioning elements 32 a manually adjustable hydraulic cylinder 40 interposed between the upright support 21 and a connection piece 28 for providing appropriate and adjustable supporting force. Both sides of the connection piece 28 are pivotally connected to the upright support 21 and the platform 30, respectively. When the platform 30 is forced to move upwardly or downwardly, the connection piece 28 is also movable therewith. Therefore, the operator may conveniently set a personally suitable value of supporting force under reference of the detection value of the invention by use of a manually adjustable knob 41.

Figure 3:
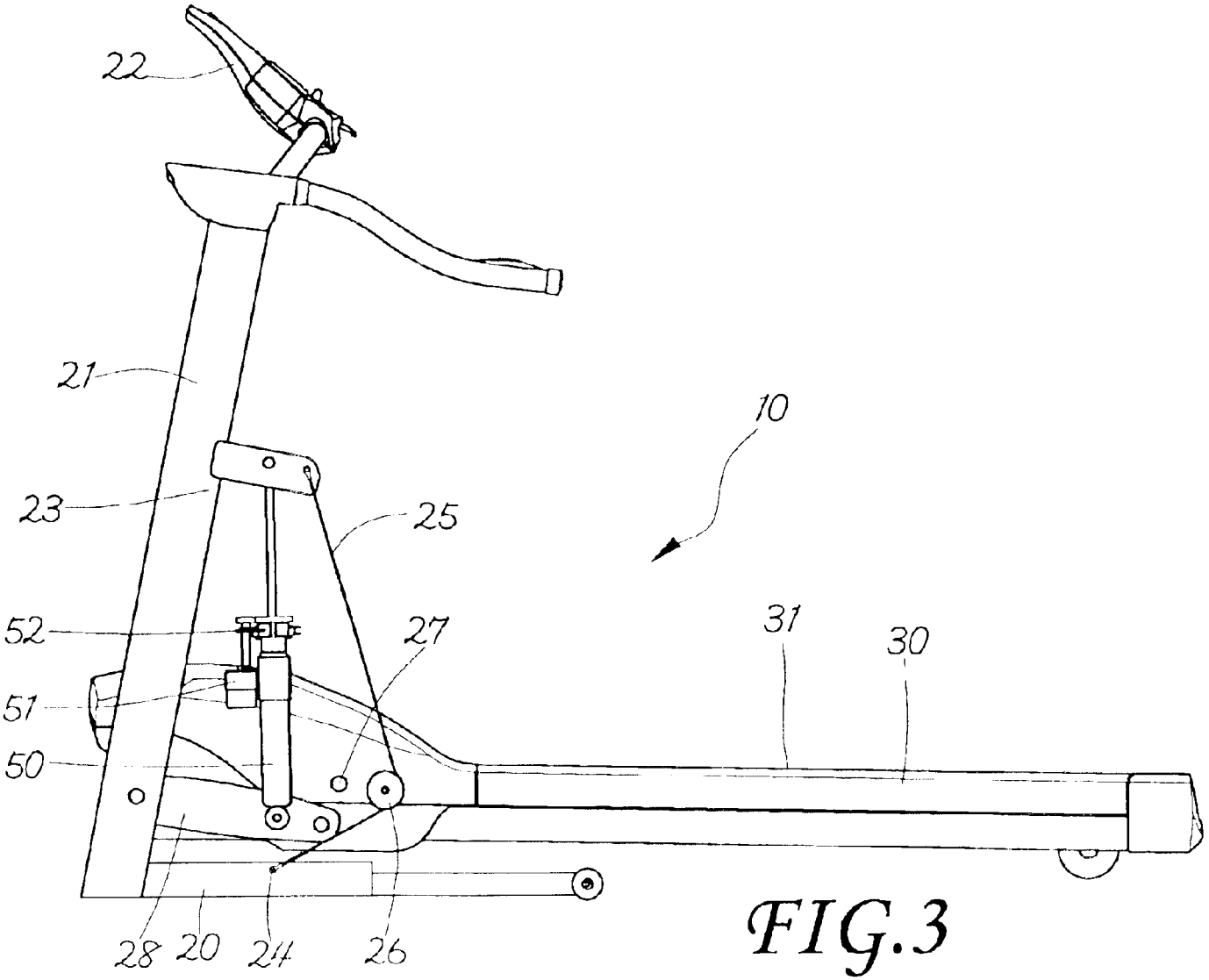
FIG. 3 is a schematic drawing of a further embodiment of the invention.

Additionally, referring to FIG. 3, the invention is applied to one of the most modern treadmills having instead of the cushioning elements 32 an electrically adjustable hydraulic cylinder 50 with a driving motor 51 and a reduction gear box 52. The driving motor 51 of the electrically adjustable hydraulic cylinder 50 is automatically controlled by the microprocessor of the control console 22 and the built-in software program for duly adjusting the supporting force of the electrically adjustable hydraulic cylinder 50. It's only required for the operator to set the staged difference by use of the control console 22. Therefore, the displacement detector of the invention, the electrically adjustable hydraulic cylinder 50 and the control program integrally work to supply a self-set stable supporting force without concerning about how much the force acts on the platform 30.

The above-mentioned software program is not the object of the invention so that no further descriptions are given hereinafter.

Figure 4:
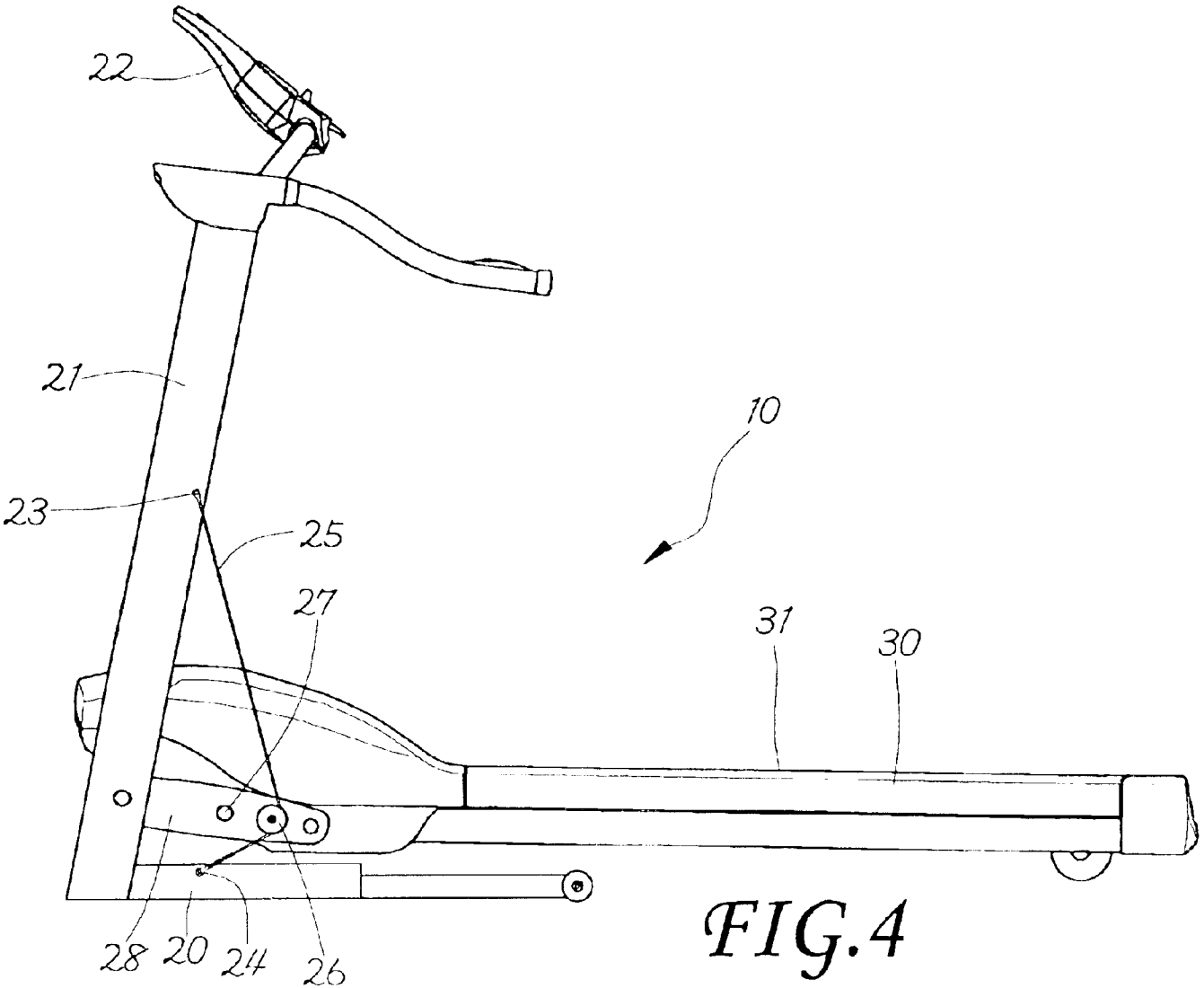
FIG. 4 is a schematic drawing of still another embodiment of the invention.

FIG. 4 shows a modified embodiment of the invention wherein the rotating element 26 and the detecting element 27 are arranged on the connection piece 28. As the connection piece 28 is movable with the platform 30, this embodiment can also achieve the expected detection effect.

In general, the invention can provide a complete and exact loading displacement data of all kinds of exercise apparatuses with loaded platform. The invention can be combined with different cushioning elements to provide the operator with more operating comfort and precaution against the exercise injuries.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A displacement detector of a platform for an exercise apparatus having a base and a platform, both sides of the base extending upwardly to form two opposing upright supports, a control console being disposed above the upright support, a continuous belt being mounted around the platform for undergoing an in-place rotation, the displacement detector comprising:

a) a rotating element positioned on the platform;

b) a rope movably tensioned by the rotating element between two fixed points on the base and the upright support, so that when the platform is forced to move upwardly and downwardly, the rotating element undergoes an in-place rotation by the pulling force of the rope; and c) a means for detecting the rotational displacement of the rotating element, the detecting means being positioned beside the rotating element on the platform, whereby the detected value is transmitted to a microprocessor in the control console.

2. The displacement detector of claim 1 wherein the rotating element and the detecting element are arranged on a connection piece that is pivotally mounted on and movable with the platform.

* * * * *